United States Patent [19]

Creedon

[11] Patent Number: 4,641,567

[45] Date of Patent: Feb. 10, 1987

[54] BARREL ASSEMBLY FOR ELECTROMAGNETIC RAIL GUN

[75] Inventor: Richard L. Creedon, San Diego, Calif.

[73] Assignee: GA Technologies Inc., San Diego, Calif.

[21] Appl. No.: 499,206

[22] Filed: May 31, 1983

[51] Int. Cl.[4] ..... F41F 1/02

[52] U.S. Cl. ..... 89/8; 124/3

[58] Field of Search ..... 89/8, 14.1; 124/3, 8; 310/12; 165/151; 310/13

[56] References Cited

U.S. PATENT DOCUMENTS

| | | | |
|---|---|---|---|
| 1,370,200 | 3/1921 | Fauchon-Villeplee | 89/8 |
| 1,384,769 | 7/1921 | MacLaren | 310/13 X |
| 1,421,435 | 7/1922 | Fauchon-Villeplee | 89/8 |
| 1,422,427 | 7/1922 | Fauchon-Villeplee | 89/8 |
| 1,985,254 | 12/1934 | Huse | 172/290 |
| 2,126,792 | 8/1938 | MacGregor | 89/14.1 |
| 2,364,944 | 12/1944 | Brown | 89/14.1 |
| 2,783,684 | 3/1957 | Yoler | 310/12 X |
| 2,894,347 | 7/1959 | Woodcock | 42/75 |
| 2,965,994 | 12/1960 | Sullivan | 89/14.1 X |
| 2,981,155 | 4/1961 | Parlanti | 42/78 X |
| 3,118,243 | 1/1964 | Manshel | 42/76 |
| 3,126,789 | 3/1964 | Meyer | 89/8 |
| 3,431,816 | 3/1969 | Dale | 89/8 |
| 3,571,962 | 3/1971 | Eig | 42/76 |
| 3,613,499 | 10/1971 | Hubbard et al. | 89/8 |
| 3,727,513 | 4/1973 | Wicks | 89/14.1 |
| 4,343,223 | 8/1982 | Hawke et al. | 89/8 |
| 4,347,463 | 8/1982 | Kemeney et al. | 124/3 X |
| 4,433,607 | 2/1984 | Kemeny | 89/8 |
| 4,449,441 | 5/1984 | McAllister | 89/8 |
| 4,458,577 | 7/1984 | Fisher et al. | 89/8 |

OTHER PUBLICATIONS

Defense Technical Information Center Technical Report AFATL-TR-81-99, entitled "Study of an Electromagnetic Gun System for Air Defense", by I. R. McNab and D. W. Deis, Nov. 81, pp. 95-112.

*Primary Examiner*—David H. Brown
*Assistant Examiner*—John E. Griffiths
*Attorney, Agent, or Firm*—Fitch, Even, Tabin & Flannery

[57] ABSTRACT

A barrel assembly for an electromagnetic rail gun is strong enough to withstand bursting forces generated during firing of the gun and has cooling capacity sufficient to enable the barrel to be fired repeatedly without overheating. The barrel includes a pair of elongated, generally parallel conductive rails having radially outwardly extending fins for structural support and heat transfer.

3 Claims, 4 Drawing Figures

FIG. 1
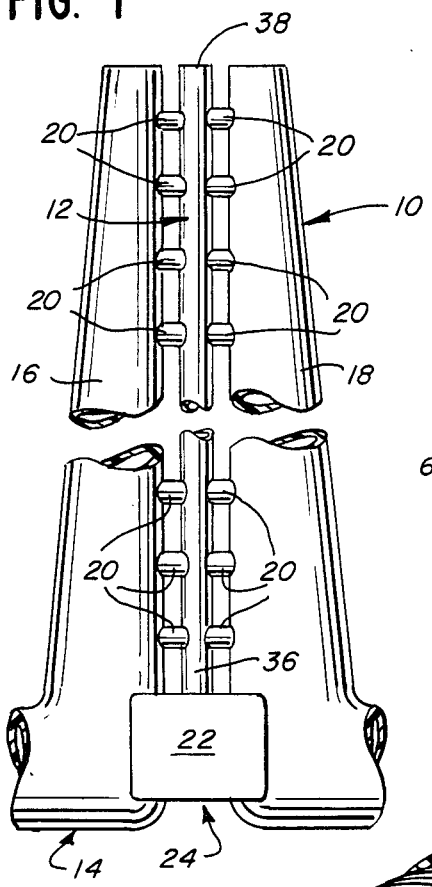
FIG. 4
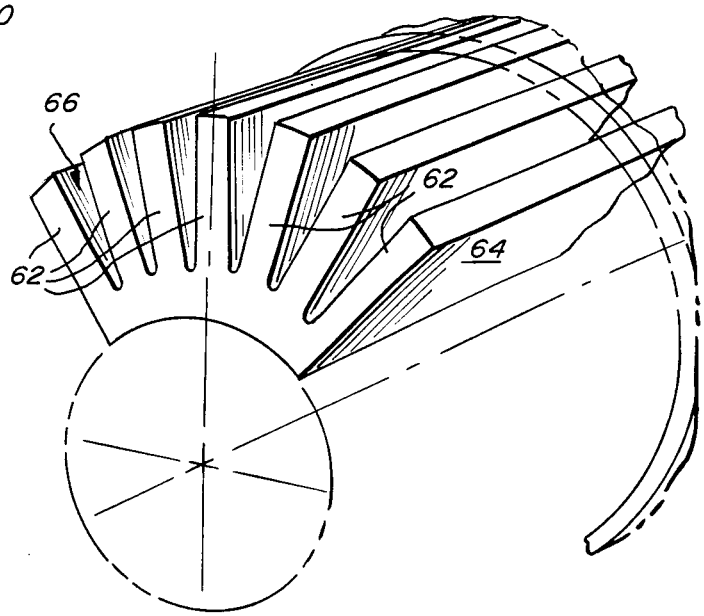
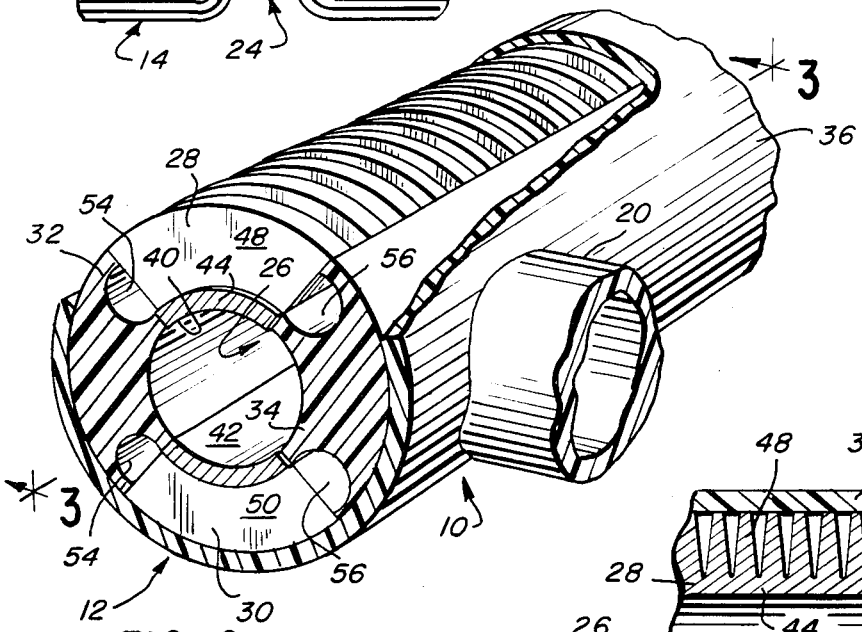
FIG. 2
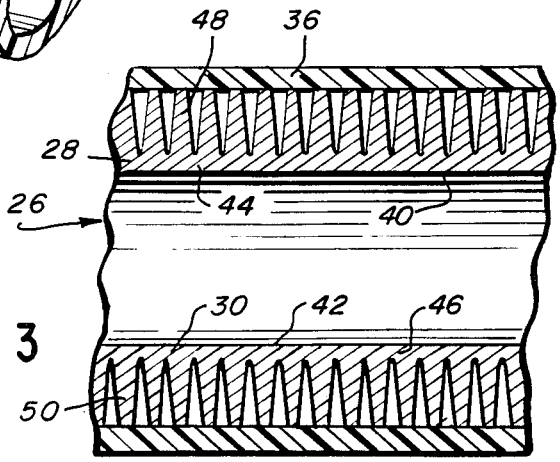
FIG. 3

BARREL ASSEMBLY FOR ELECTROMAGNETIC RAIL GUN

BACKGROUND OF THE INVENTION

The present invention relates to electromagnetic rail guns and more particularly to barrel assemblies therefore.

Various types of rail guns have been proposed for using electromagnetic forces to accelerate projectiles to high velocities and direct them toward targets. See, for example, U.S. Pat. No. 1,985,254.

A typical rail gun includes an elongated barrel which has a pair of longitudinally extending parallel conductors or rails disposed symmetrically about its longitudinal axis. The rails are connected at their rearward or breech ends to opposite terminals of a source of direct current. A circuit through the rails may be completed either by a movable conductor disposed between the rails or by a plasma arc between the rails. This results in the flow of current that generates magnetic flux between the rails, and the flux cooperates with the current in the conductor or the plasma to accelerate the conductor or plasma forward between the rails. The projectile may include the conductor or may be positioned forward of the conductor or plasma arc and driven forward thereby.

When the rail gun is fired, substantial transverse electromagnetic forces are generated which tend to push the rails apart. In addition, heat is generated by the current flow. Because relatively high current is generally necessary to achieve the desired projectile velocity, both the transverse electromagnetic forces and the heat may be of such magnitude as to cause failure of the barrel after a single firing.

Rail guns capable of rapid fire have been proposed, but removal of heat from the barrels has been a problem. When a rail gun is fired repeatedly, the barrel temperature rises with each firing unless a cooling system capable of removing heat at a very high rate is employed. In the past, rail guns have had rails with longitudinal cooling channels formed through them, but no known rail gun barrels have combined cooling systems capable of enabling rapid fire with structural support adequate to withstand the transverse forces on the rails.

SUMMARY OF THE INVENTION

In accordance with the present invention, there is provided a rail gun barrel assembly which is strong enough to withstand the electromagnetic forces generated during firing of the gun and which has cooling capacity sufficient to enable the gun to be fired repeatedly without causing the barrel to overheat. The barrel includes a pair of elongated, generally parallel conductive rails disposed symmetrically about the axis of the barrel, a pair of elongated insulating members disposed generally coextensively with the rails and circumferentially between the rails, and an outer shell for constraining the rails and insulating members against radial movement. Each rail includes a longitudinally extending inner portion and a plurality of fins extending outward from the rail to the shell. Each fin preferably has an approximately constant longitudinal circular sectional area at every radius—i.e., at any particular radius from the axis of the bore, the sectional area of each fin is approximately equal to its sectional area at any other radius.

In accordance with one embodiment of the present invention, the fins are disposed transversely and are tapered, decreasing in thickness as they proceed radially outward. In accordance with an alternate embodiment, the fins are disposed longitudinally and have parallel, generally planar sides.

BRIEF DESCRIPTION OF THE DRAWINGS

FIG. 1 is a foreshortened plan view of a rail gun barrel assembly embodying the present invention.

FIG. 2 is a perspective view of a portion of the rail gun barrel assembly of FIG. 1, shown partially in section and with portions broken away for clarity.

FIG. 3 is a sectional view of the portion of the rail gun barrel assembly shown in FIG. 2, taken substantially along line 3—3 in FIG. 2 and looking in the direction of the arrows.

FIG. 4 is a diagrammatic view of a portion of a rail gun barrel constructed in accordance with an alternative embodiment of the present invention.

DETAILED DESCRIPTION OF PREFERRED EMBODIMENTS

The present invention is generally embodied in a barrel assembly 10 for a rail gun. Referring to FIG. 1, the barrel assembly 10 includes a barrel 12 and a cooperating coolant circulation system 14. The coolant circulation system 14 includes a supply pipe 16 which extends along one side of the barrel to supply coolant for controlling the temperature of the barrel, and a drain pipe 18 which extends along the opposite side of the barrel for carrying coolant fluid away from the barrel. A plurality of relatively small diameter tubes 20 connect the respective supply and drain pipes 16, 18 to the barrel at spaced intervals. Means 22 are provided for loading projectiles into the barrel 12 at its breech end 24.

As best seen in FIG. 2, the barrel 12 defines a central bore 26 through which a projectile (not shown) passes as the rail gun is fired. The bore may be cylindrical, as shown, or may be of rectangular or other cross section. A pair of elongated, generally parallel conductive rails 28, 30 are disposed symmetrically about the longitudinal axis of the bore. The rails 28, 30 are electrically connected at their respective rearward or breech ends to opposite terminals of a source of direct current (not shown). The rails may be made of a copper alloy or other suitable material. A pair of insulating members 32, 34 are disposed generally coextensively with the rails 28, 30 to electrically insulate them from one another. The insulating members have passages formed through them for directing coolant flow. An outer strength shell 36 is disposed about the rails 28, 30 and insulating members 32, 34 coaxially with the bore 26 of the barrel 12 to provide hoop forces for confining the rails and insulating members and constraining them against displacement radially outward.

When the rail gun fires, electromagnetic force accelerates a projectile from the rearward or breech end 24 of the barrel 12 to the forward or muzzle end 38. The electromagnetic force is generated by direct current which passes longitudinally along one rail 28 from its breech end to a conductor or plasma arc (not shown) between the rails and back to the breech end along the other rail 30. The current in the rails creates electromagnetic flux between the rails. The electromagnetic flux interacts with the current in the conductor or plasma arc to produce forces which accelerate the conductor or plasma arc and, hence, the associated projectile forward. The magnetic forces also urge the rails 28, 30 apart.

In addition to producing electromagnetic forces, the current through the rails 28, 30 and the conductor or plasma arc heats the rails. The velocity which may be achieved by the projectile is partially dependent upon the magnitude of the current passed through the electrical circuit. Achievement of extremely high velocity is generally desirable, and to this end very high current is generally employed. The current may be so high that the rails 28, 30 are damaged by the heat produced in them by the current due to their electrical resistance.

The present invention is directed particularly toward providing a barrel assembly capable of rapid fire. Repeated firing presents more serious thermal problems than single shot operation because each firing generates heat so that the rail temperature tends to rise with each successive firing. Unless heat is removed from the barrel at approximately the rate at which it is generated, the number of times the gun may be fired within a particular interval of time will be limited by the temperatures which the barrel material can tolerate.

Generation of heat in the barrel 12 begins when the rails 28, 30 are energized with the projectile at the breech end 24 of the barrel. As the projectile travels forward through the barrel 12, the length of the current path increases continuously. It will be appreciated that the length of time during which a portion of a rail carries current, and consequently the amount of heat generated in a portion of a rail, is inversely related to its distance from the breech ends of the rails. Accordingly, there is generally a temperature gradient along the rails after firing, with the breech ends being at the highest temperature. The inner surfaces 40, 42 of the rails 28, 30 are generally at higher temperatures than adjacent radially outer portions of the rails because the current through the rails is typically highest through the inner surfaces of the rails, and because the inner surfaces of the rails are closest to the heat generated in the conductor or plasma arc traveling through the bore 26 of the barrel.

In the illustrated embodiment of the present invention, a coolant, such as deionized water, is used for cooling the barrel 12 by forced convection. In order to maximize the rate of convective heat transfer from the rails 28, 30, it is desirable to maximize the volume of coolant which may contact the rails and to have the coolant pass relatively close to the inner rail surfaces 40, 42 which are at the highest temperatures. The configuration of the rails 28, 30 of the present invention is directed toward both of these thermal objectives. In addition, the rail configuration is directed toward maximizing the magnetic field strength between the rails.

In accordance with the present invention, each rail includes a relatively thin, longitudinally extending inner portion 44, 46 and a plurality of fins 48, 50 extending outward from the inner portion 44, 46 to the shell 36. The fins 48, 50 carry radial loads to react the forces urging the rails 28, 30 apart and cool the inner portions 44, 46 of the rails by thermal conduction and by presenting relatively large surface areas to the coolant to facilitate convective cooling. In the embodiment illustrated in FIGS. 1–3, the fins are disposed transversely, and each fin 48, 50 is configured so as to be of the minimum volume necessary for its structural function. The transverse disposition of the fins and the minimization of their volumes provide a support structure of relatively low reluctance, which increases the magnetic field strength obtainable within the barrel. The number and thickness of the fins in a particular barrel embodying the present invention may be determined according to the heat transfer parameters of the particular barrel.

Each fin necessarily increases in circumferential dimension as it proceeds radially outwardly from the bore 26 of the barrel 12. If each fin 48, 50 were of uniform thickness over its entire volume, compressive stress on a fin would produce a stress gradient in the fin with stress increasing proceeding radially inward along the fin. The fins of the present invention are configured to reduce or eliminate this stress gradient—i.e., to substantially equalize radial stresses throughout the fin.

In accordance with the embodiment of the present invention illustrated in FIGS. 1–3, each fin 48, 50 is tapered so as to be of approximately constant longitudinal circular sectional area at each radius throughout its volume so that radial forces are distributed over equal areas at each radial position in the fin. This enables the fin volume to be substantially minimized at a point where the sectional area is sufficient to carry the radial compression forces generated during firing.

The variation of fin thickness as a function of its radial position may be described by the equation $t=k/r$, where t is the thickness, or longitudinal dimension of the fin at a particular radius, r is the radius, and k is a constant determined by structural analysis.

Minimizing the volume of each fin maximizes the space available between the fins for coolant flow. This increases the volume of fluid that may carry heat away from the fins by enabling more coolant to be between the fins at any particular time and by lowering head loss so that the rate of fluid flow can be increased. The number of fins 48, 50 and their specific configurations may be determined according to the strength requirements and the cooling requirements of the particular barrel 12. It will be appreciated that more fin surface area may be exposed to coolant by increasing the number of fins, while greater strength may be obtained by increasing the aggregate volume of the fins within limits.

The magnetic advantages associated with this fin configuration derive both from the transverse orientation of the fins and from the minimization of fin volume. The lines of magnetic flux extend generally circumferentially about the inner portions 44, 46 of the rails. Because the current flows through the rails as a pulse rather than at a steady rate, the magnetic flux density about the inner portions of the rails increases very rapidly. Where the magnetic flux lines must pass through metal, the rate of increase of flux density is retarded due to induction of eddy currents in the metal. The transverse orientation of the fins of the present invention provides flux paths between the fins uninterrupted by conductive material. Minimization of the fin volume increases the space for flux between the fins and additionally reduces losses due to eddy currents in the fins.

It is desirable that the outer shell be non-metallic to keep reluctance within acceptable limits. In addition, it is desirable to keep the mass of the shell 36 relatively low to facilitate aiming of the rail gun. Accordingly, the outer shell is preferably made of a lightweight, high strength material such as glass or silicon carbide composite material.

Each insulating member 32, 34 herein has internal passages for distributing coolant to the spaces between the fins. One insulating member 32 serves as a supply manifold while the insulating member 34 on the opposite side functions as a drain manifold.

Referring to FIG. 3, each insulator 32, 34 has generally longitudinal channels 54, 56 extending along its opposite sides adjacent the fins 48, 50 and a series of ports (not shown) internally connected with the longitudinal channels. The ports are aligned with ports in the outer shell 36 and connected to the tubes 20 which are connected to the respective supply and drain pipes 16, 18. Coolant is carried from the breech end of the supply pipe 16 forward to the various tubes 20 and back through the breech end of the drain pipe 18. The flow rate in each pipe 16, 18 is greatest near its breech end, and accordingly the pipes are preferably tapered, increasing in diameter toward their breech ends. To prevent short circuiting between the rails, the coolant must be non-conductive material, such as deionized water.

As noted above, the bore need not be of circular cross-section as illustrated herein, but may be of rectangular cross-section or other suitable shape. The diameter of the illustrated cylindrical bore may be between 0.5 cm and 2 cm.

Turning now to FIG. 4, there is shown diagrammatically an alternative embodiment of the present invention wherein the barrel includes rails 60 having fins 62 which extend longitudinally rather than transversely of the barrel. The fins 62 in this embodiment have generally planar, parallel sides 64 so that the fins 62 are of approximately constant longitudinal circular sectional area at each radius throughout. Suitable means are employed for circulating coolant in the spaces 66 between the fins 62.

From the foregoing, it will be appreciated that the present invention provides a novel rail gun barrel which may withstand repeated firing without overheating or bursting. While particular embodiments of the invention are illustrated and described herein, there is no intent to limit the scope of the invention to these or any particular embodiments.

What is claimed is:

1. A rail gun barrel assembly defining an elongated bore, said barrel assembly comprising:

a pair of elongated, generally parallel conductive rails extending along opposite sides of the bore and being symmetrical about the longitudinal axis defined by the bore;

a pair of elongated insulating members disposed generally coextensively with said rails, said insulating members having passages formed in them for carrying coolant fluid;

an elongated, generally cylindrical outer shell disposed substantially coaxially of the bore for radially constraining said rails and insulating members, said outer shell having ports formed through it to enable coolant to pass therethrough;

coolant supply means for supplying coolant fluid through some of said ports into said passages in said insulating members; and coolant drain means for draining coolant from said passages of said insulating members through others of said ports;

each of said rails comprising a longitudinally extending inner portion for carrying current and a plurality of transverse fins extending radially outward from said inner portion to said shell to react bursting forces generated in said bore;

each of said fins being tapered in thickness so as to be of approximately constant longitudinal circular sectional area at each radius throughout;

whereby radial compressive stresses in each of said fins due to bursting forces generated in said bore are substantially equalized over the radial dimension of each of said fins due to the approximately constant longitudinal circular sectional area at each radius of each of said fins.

2. A rail gun barrel assembly in accordance with claim 1 wherein the bore is circular and has a diameter between about 0.5 cm. and 2 cm.

3. A rail gun barrel assembly in accordance with claim 1 wherein said fins are integral with said inner portions of said rails.

* * * * *